US009877543B2

(12) United States Patent
Peyton

(10) Patent No.: US 9,877,543 B2
(45) **Date of Patent: *Jan. 30, 2018**

(54) ARTICLE OF FOOTWEAR HAVING A SOLE STRUCTURE INCORPORATING A PLATE AND CHAMBER

(71) Applicant: NIKE, Inc., Beaverton, OR (US)

(72) Inventor: Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 90 days.

This patent is subject to a terminal disclaimer.

(21) Appl. No.: 14/707,569

(22) Filed: May 8, 2015

(65) Prior Publication Data

US 2015/0237955 A1 Aug. 27, 2015

Related U.S. Application Data

(63) Continuation of application No. 12/985,675, filed on Jan. 6, 2011, now Pat. No. 9,055,784.

(51) Int. Cl.

| | |
|---|---|
| ***A43B 13/14*** | (2006.01) |
| ***A43B 13/20*** | (2006.01) |
| ***A43B 13/12*** | (2006.01) |
| ***A43B 13/18*** | (2006.01) |

(52) U.S. Cl.

CPC ..... *A43B 13/125* (2013.01); *A43B 13/12* (2013.01); *A43B 13/189* (2013.01); *A43B 13/20* (2013.01)

(58) Field of Classification Search

CPC ..... A43B 13/125; A43B 13/12; A43B 13/189; A43B 13/20

See application file for complete search history.

(56) References Cited

U.S. PATENT DOCUMENTS

| | | | |
|---|---|---|---|
| 1,620,797 | A | 3/1927 | Bonaventure |
| 3,244,177 | A | 4/1966 | Scholl |
| 3,253,355 | A | 5/1966 | Menken |
| 3,523,379 | A | 8/1970 | Barsam et al. |

(Continued)

FOREIGN PATENT DOCUMENTS

| | | | |
|---|---|---|---|
| EP | 890322 | A1 | 1/1999 |
| WO | 2000070981 | A1 | 11/2000 |
| WO | 2003056964 | A1 | 7/2003 |

OTHER PUBLICATIONS

International Search Report and Written Opinion in PCT Application No. PCT/US2012/020155, dated May 29, 2012.

(Continued)

*Primary Examiner* — Jila M Mohandesi

(74) *Attorney, Agent, or Firm* — Honigman Miller Schwartz and Cohn LLP; Matthew H. Szalach; Jonathan P. O'Brien

(57) ABSTRACT

A sole structure may include a midsole element, a plate, a first chamber, and a second chamber. The midsole element may be formed from a foamed polymer material. The plate may be formed from a substantially non-foamed polymer material, and the plate has an upper surface and an opposite lower surface. The plate is embedded within the midsole element such that the foamed polymer material exposes a first area and a second area of the lower surface. The first chamber and the second chamber each have a fluid-filled configuration. The first chamber is secured to the first area, and the second chamber is secured to the second area.

12 Claims, 18 Drawing Sheets

(56) References Cited

U.S. PATENT DOCUMENTS

| | | | | |
|---|---|---|---|---|
| 4,128,950 | A | 12/1978 | Bowerman et al. | |
| 5,191,727 | A | 3/1993 | Barry et al. | |
| 5,220,737 | A | 6/1993 | Edington | |
| 5,224,280 | A | 7/1993 | Preman et al. | |
| 5,381,608 | A | 1/1995 | Claveria | |
| 5,842,291 | A | 12/1998 | Schmidt et al. | |
| 5,956,869 | A | 9/1999 | Kim | |
| 5,996,257 | A | 12/1999 | Harrison | |
| 6,219,939 | B1 | 4/2001 | Kita et al. | |
| 6,354,020 | B1 | 3/2002 | Kimball et al. | |
| 6,453,577 | B1 * | 9/2002 | Litchfield | A43B 13/203 36/29 |
| 6,487,796 | B1 | 12/2002 | Avar et al. | |
| 6,782,642 | B2 | 8/2004 | Knoche et al. | |
| 6,845,573 | B2 | 1/2005 | Litchfield et al. | |
| 6,898,870 | B1 | 5/2005 | Rohde | |
| 6,944,973 | B2 * | 9/2005 | Goodwin | A43B 13/12 36/29 |
| 6,964,120 | B2 | 11/2005 | Cartier et al. | |
| 6,968,636 | B2 | 11/2005 | Aveni et al. | |
| 7,082,698 | B2 | 8/2006 | Smaldone et al. | |
| 7,096,605 | B1 | 8/2006 | Kozo et al. | |
| 7,100,309 | B2 | 9/2006 | Smith et al. | |
| 7,181,867 | B2 | 2/2007 | Litchfield et al. | |
| 7,243,443 | B2 | 7/2007 | Swigart | |
| 7,313,876 | B2 * | 1/2008 | Morgan | A43B 1/0027 36/59 R |
| 7,386,946 | B2 * | 6/2008 | Goodwin | A43B 13/20 36/28 |
| 7,421,808 | B2 | 9/2008 | Baier et al. | |
| 7,426,792 | B2 | 9/2008 | Swigart et al. | |
| 7,533,477 | B2 | 5/2009 | Goodwin et al. | |
| 7,810,256 | B2 | 10/2010 | Goodwin et al. | |
| 9,044,067 | B2 * | 6/2015 | Edington | A43B 7/144 |
| 9,055,784 | B2 * | 6/2015 | Peyton | A43B 13/125 |
| 2005/0132607 | A1 | 6/2005 | Dojan et al. | |
| 2005/0132608 | A1 * | 6/2005 | Dojan | A43B 13/20 36/29 |
| 2006/0230636 | A1 | 10/2006 | Kokstis et al. | |
| 2007/0074423 | A1 | 4/2007 | Goodwin et al. | |
| 2007/0163150 | A1 | 7/2007 | Yang | |
| 2008/0086916 | A1 | 4/2008 | Ellis | |
| 2009/0064535 | A1 | 3/2009 | Spanks et al. | |
| 2009/0090025 | A1 | 4/2009 | Cassiday et al. | |
| 2009/0126232 | A1 | 5/2009 | Cholewa | |
| 2009/0183387 | A1 | 7/2009 | Ellis | |
| 2009/0183393 | A1 | 7/2009 | Lee | |
| 2009/0288314 | A1 | 11/2009 | Kay | |
| 2010/0107444 | A1 | 5/2010 | Aveni et al. | |
| 2010/0107445 | A1 | 5/2010 | Aveni et al. | |
| 2010/0122471 | A1 * | 5/2010 | Edington | A43B 7/144 36/28 |
| 2011/0005099 | A1 | 1/2011 | Aveni et al. | |
| 2011/0035966 | A1 | 2/2011 | Geer et al. | |

OTHER PUBLICATIONS

International Preliminary Report on Patentability in PCT Application No. PCT/US2012/020155 dated Jul. 18, 2013.

* cited by examiner

ARTICLE OF FOOTWEAR HAVING A SOLE STRUCTURE INCORPORATING A PLATE AND CHAMBER

This application is a continuation of U.S. patent application Ser. No. 12/985,675, filed Jan. 1, 2011, which application is incorporated herein by reference.

BACKGROUND

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (i.e., providing cushioning) during walking, running, and other ambulatory activities, the sole structure may influence foot motions (e.g., by resisting pronation), impart stability, and provide traction, for example. Accordingly, the upper and the sole structure operate cooperatively to provide a comfortable structure that is suited for a wide variety of athletic activities.

The upper is often formed from a plurality of material elements (e.g., textiles, polymer sheets, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole structure generally incorporates multiple layers: a sockliner, a midsole, and an outsole. The sockliner is a thin, compressible member located within the upper and adjacent to a plantar (i.e., lower) surface of the foot to enhance footwear comfort. The midsole is secured to a lower surface of the upper and forms a middle layer of the sole structure. Many midsole configurations are primarily formed from a resilient polymer foam material, such as polyurethane or ethylvinylacetate, that extends throughout the length and width of the footwear. The midsole may also incorporate fluid-filled chambers, plates, moderators, or other elements that further attenuate forces, influence the motions of the foot, or impart stability, for example. The outsole forms the ground-contacting element of the footwear and may be fashioned from a durable and wear-resistant material (e.g., rubber) that includes texturing to improve traction.

SUMMARY

Various aspects of a sole structure for an article of footwear are disclosed below. In general, the sole structure may include a midsole element, a plate, a first chamber, and a second chamber. The midsole element may be formed from a foamed polymer material. The plate may be formed from a substantially non-foamed polymer material, and the plate has an upper surface and an opposite lower surface. The plate is embedded within the midsole element such that the foamed polymer material exposes a first area and a second area of the lower surface. The first chamber and the second chamber each have a fluid-filled configuration. The first chamber is secured to the first area, and the second chamber is secured to the second area.

Methods for manufacturing the sole structure are also disclosed below. In one example, a method includes locating a plate within a mold, with at least eighty percent of the plate having a thickness in a range of 0.5 and 1.5 millimeters. A foamed polymer material is injected into the mold and extends around the plate, and the foamed polymer material exposes at least a first area and a second area of a surface of the plate. A first chamber is secured to the first area of the plate and a second chamber is secured to the second area of the plate.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose an article of footwear having a sole structure that includes, for example, a midsole element, a plate, and one or more fluid-filled chambers. The article of footwear is disclosed as having a general configuration suitable for running. Concepts associated with the footwear may also be applied to a variety of other athletic footwear types, including baseball shoes, basketball shoes, cross-training shoes, cycling shoes, football shoes, golf shoes, tennis shoes, soccer shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

Footwear Structure

Figure 1:
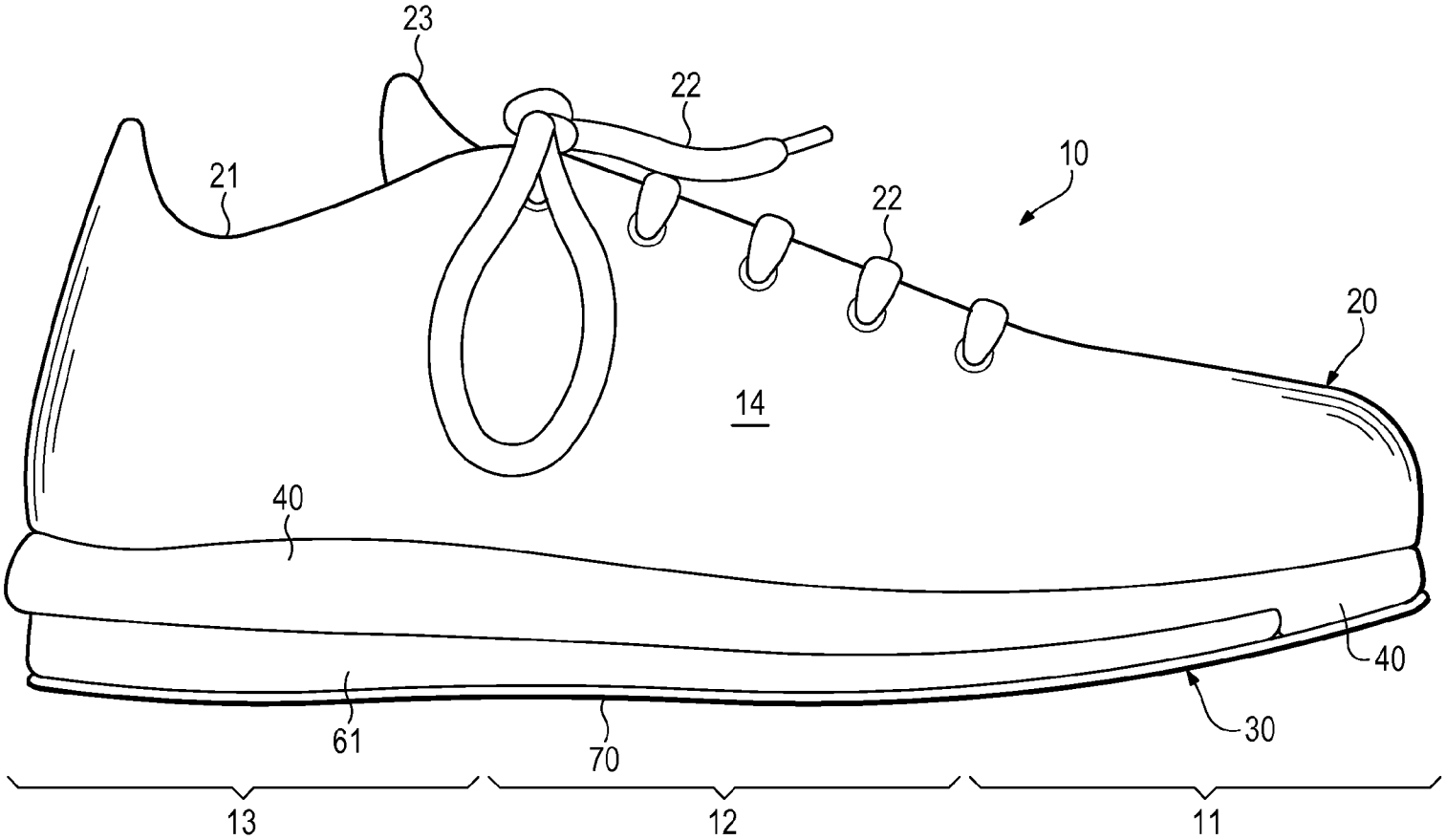
FIG. 1 is lateral side elevational view of an article of footwear.
Figure 2:
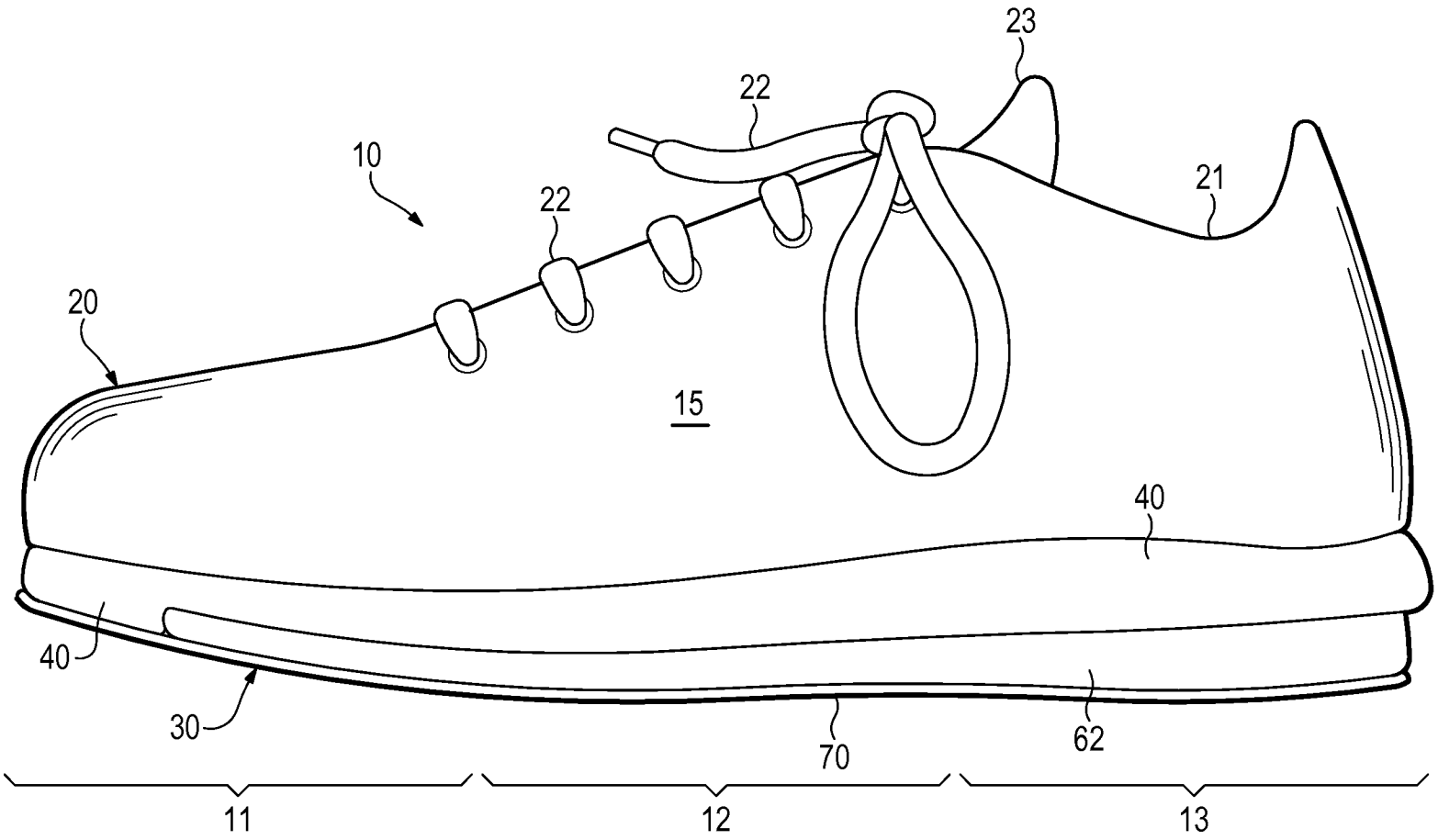
FIG. 2 is a medial side elevational view of the article of footwear.
Figure 3:
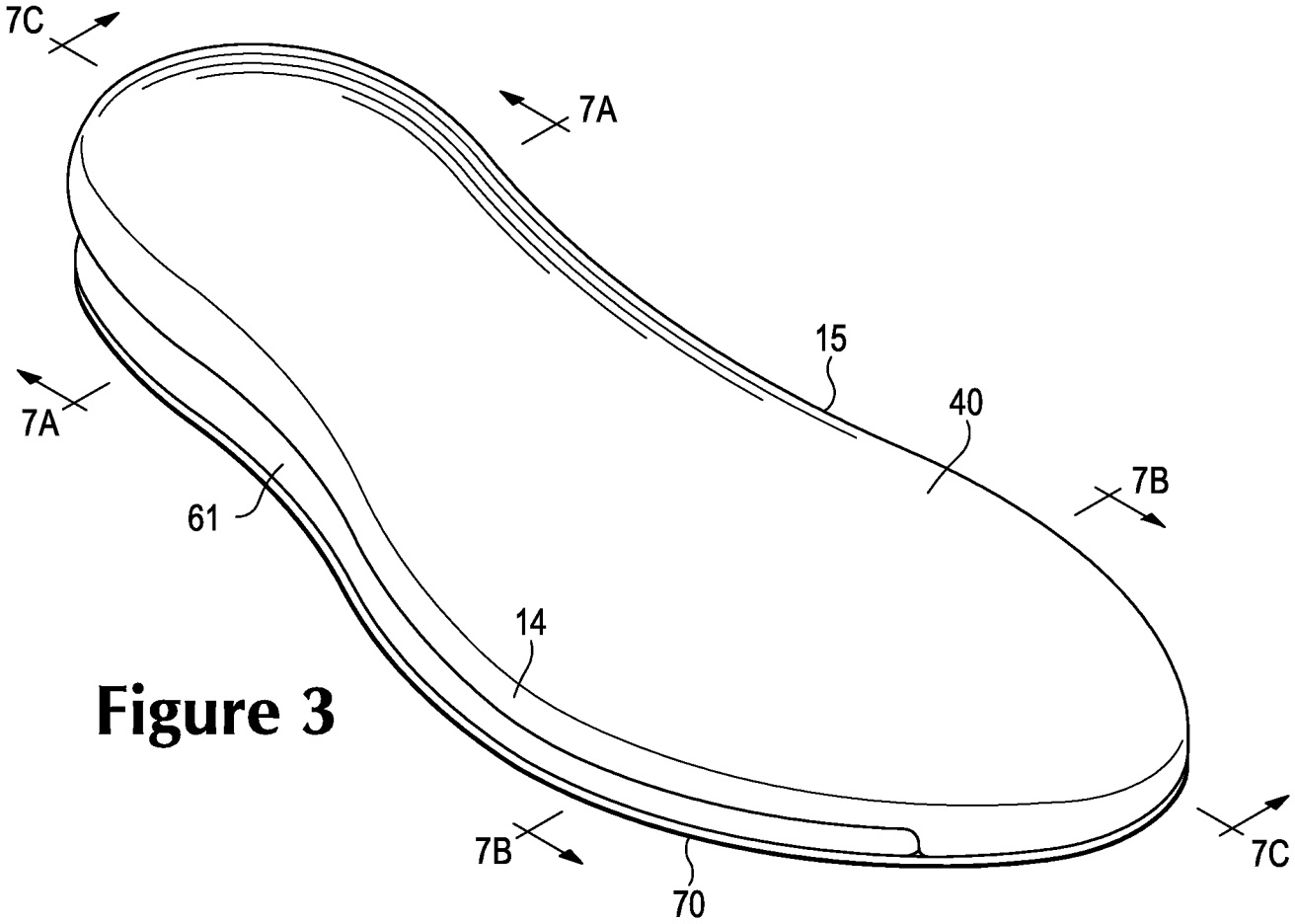
FIG. 3 is a first perspective view of a sole structure of the article of footwear.
Figure 4:
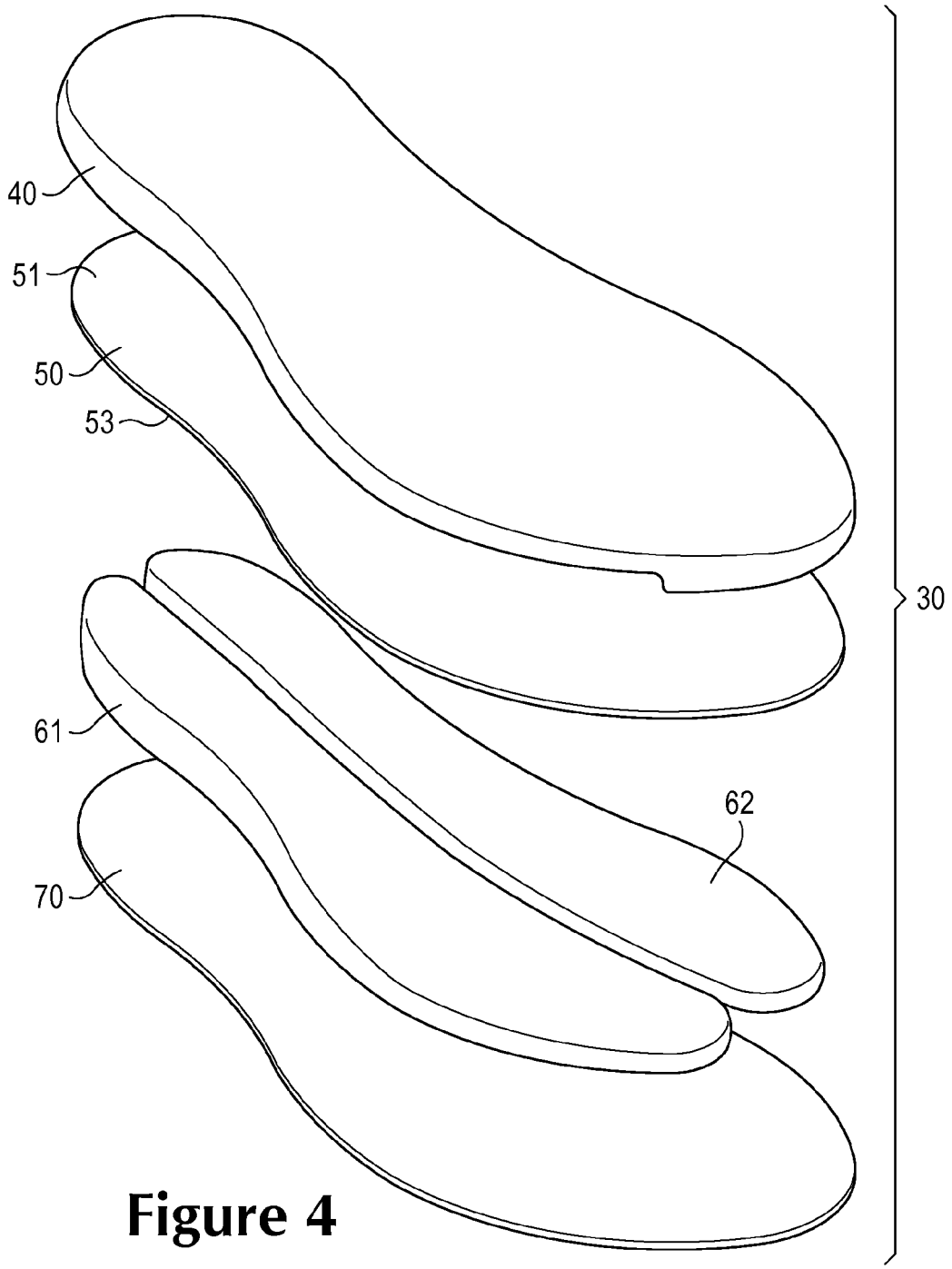
FIG. 4 is a first exploded perspective view of the sole structure.
Figure 5:
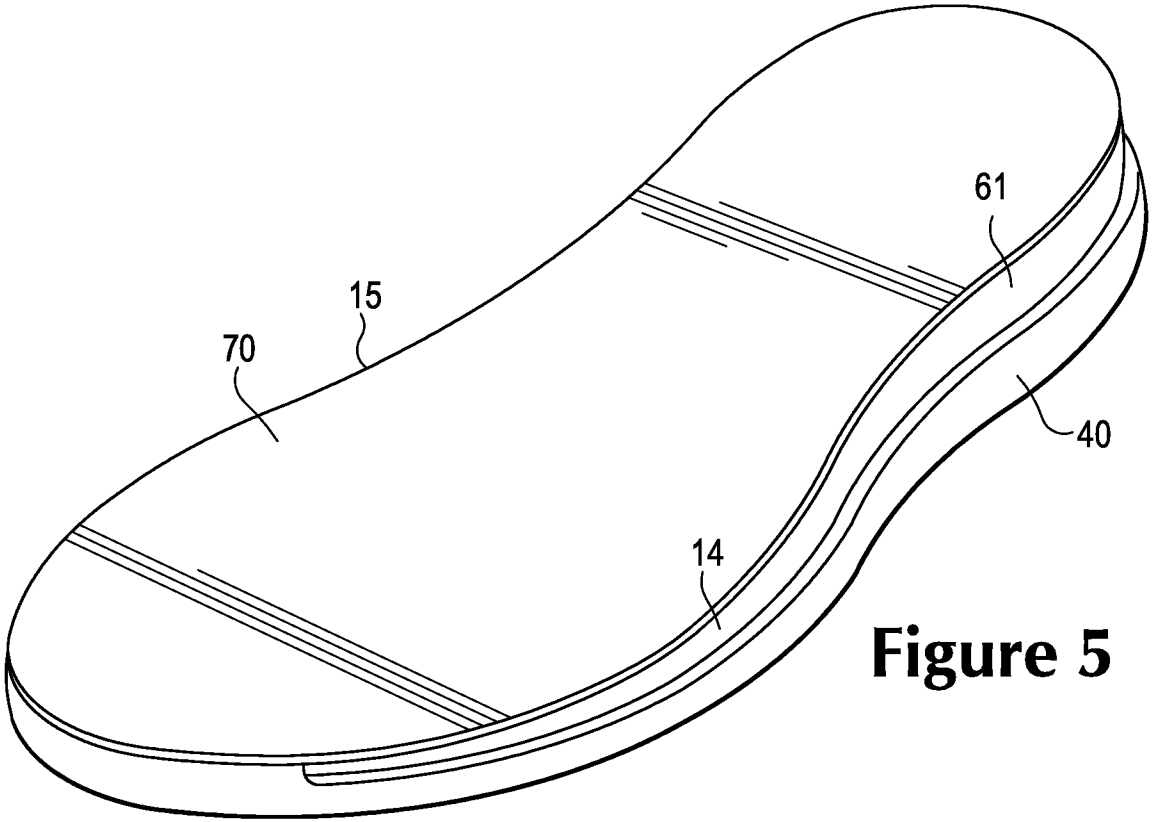
FIG. 5 is a second perspective view of the sole structure.
Figure 6:
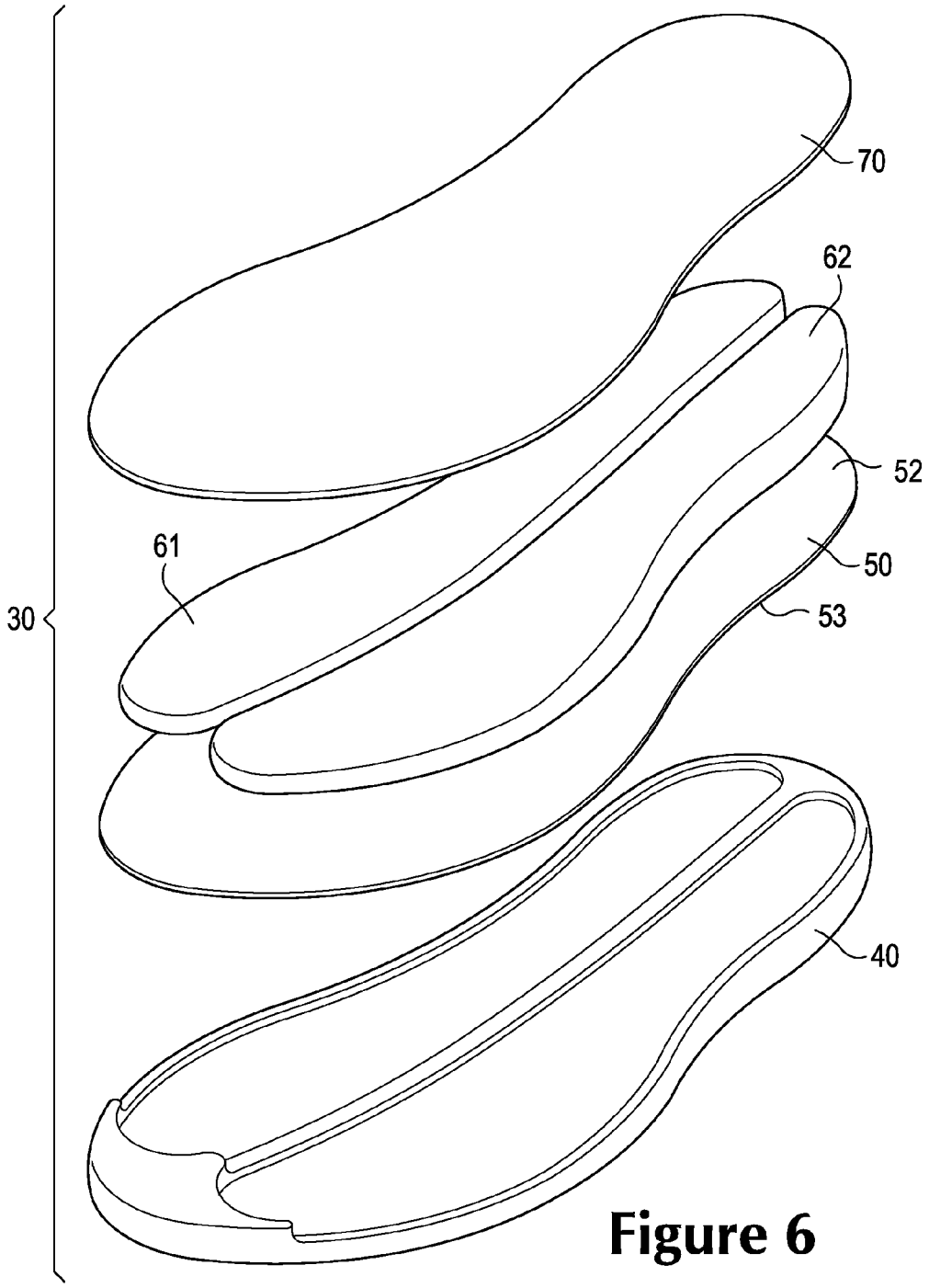
FIG. 6 is a second exploded perspective view of the sole structure.
Figure 7A:
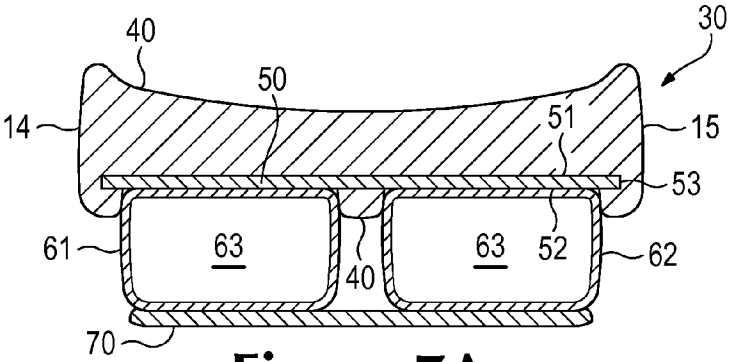
FIGS. 7A-7C are cross-sectional views of the sole structure, as respectively defined by section lines 7A-7C in FIG. 3.
Figure 7B:
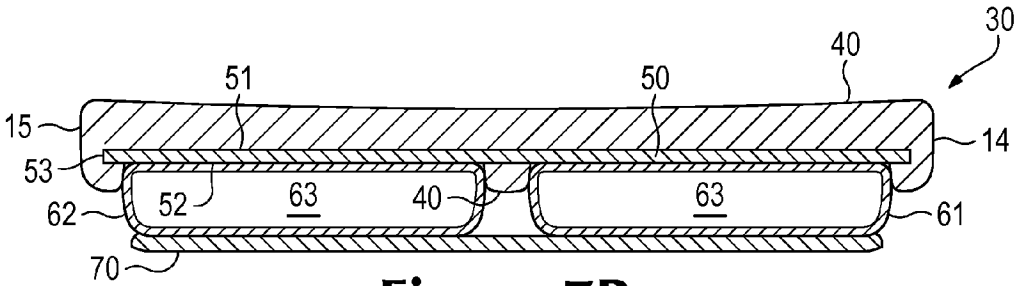
Figure 7C:
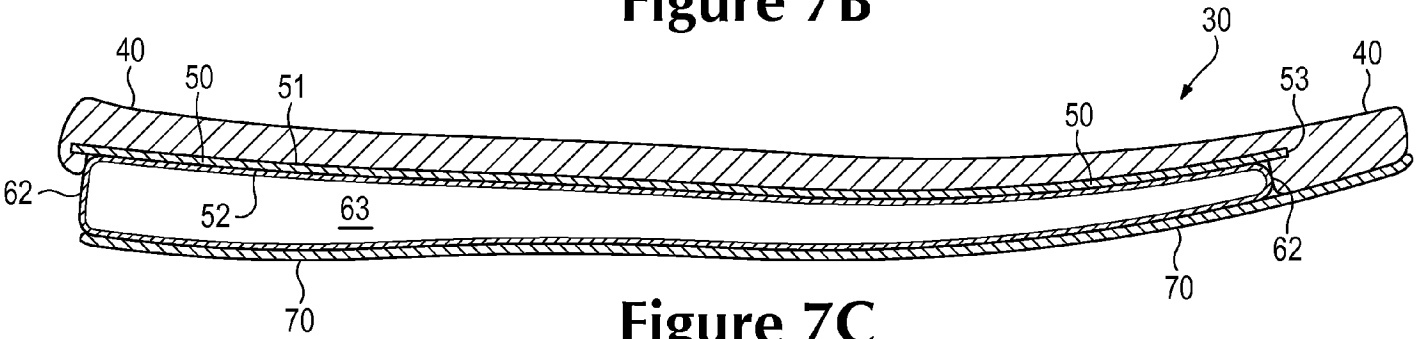

An article of footwear 10 is depicted in FIGS. 1 and 2 as including a sole structure 30 and an upper 20. For reference purposes, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion 23 of upper 20 may extend between the interior void and lace 22. Given that various aspects of the present discussion primarily relate to sole structure 30, upper 20 may exhibit the general configuration discussed above or the general configuration of practically any other conventional or non-conventional upper. Accordingly, the overall structure of upper 20 may vary significantly.

Sole structure 30 is secured to upper 20 and has a configuration that extends between upper 20 and the ground. In addition to attenuating ground reaction forces (i.e., cushioning the foot), sole structure 30 may provide traction, impart stability, and limit various foot motions, such as pronation. The primary elements of sole structure 30, as depicted in FIGS. 3-7C, are a midsole element 40, a plate 50, two chambers 61 and 62, and an outsole 70. Each of these elements will be discussed in greater detail below.

Midsole element 40 is secured to a lower area of upper 20 (e.g., through stitching, adhesive bonding, or thermal bonding) and extends through each of regions 11-13 and between sides 14 and 15. Portions of midsole element 40 are exposed around the periphery of sole structure 30, but may also be covered by other elements, such as material layers from upper 20. Midsole element 40 is primarily formed from a foamed polymer material, such as polyurethane or ethylene vinyl acetate copolymer, that operates to attenuate ground reaction forces as sole structure 30 contacts and is compressed against the ground during walking, running, or other ambulatory activities. A lower area of midsole element 40 defines a depression, in which plate 50 is located.

Plate 50 is at least partially embedded within midsole element 40 and also extends through each of regions 11-13 and between sides 14 and 15. In further configurations of footwear 10, plate 50 may be limited to a smaller area of footwear 10. As examples, plate 50 may be primarily located in heel region 13, may be only on medial side 15, or may be located to extend under only a portion of the foot. Whereas midsole element 40 may be formed from various foamed polymer materials, plate 50 may be formed from various non-foamed polymer materials. That is, plate 50 may have a denser and less cellular aspect than midsole element 40. Examples of suitable polymer materials for plate 50 include thermoplastic and thermoset polyurethane, polyester, an alloy of polyurethane and acrylonitrile butadiene styrene, nylon, and polyether block amide, for example.

Plate 50 includes an upper surface 51, an opposite lower surface 52, and a perimeter edge 53. Upper surface 51 faces toward upper 20, and lower surface 52 faces away from upper 20 and toward outsole 70. Perimeter edge 53 extends around plate 50 and forms a periphery of plate 50. When embedded within midsole element 40, upper surface 51 is covered by the foamed polymer material of midsole element 40, a portion of lower surface 52 is exposed or otherwise uncovered by the foamed polymer material, and perimeter edge 53 is set within the foamed polymer material. That is, a majority of plate 50 is embedded within midsole element 40, but portions of lower surface 52 are exposed. Although portions of lower surface 52 are exposed, other portions are covered by the foamed polymer material. For example, areas of lower surface 52 that are adjacent to perimeter edge 53 may be covered by the foamed polymer material, and areas that are located between chambers 61 and 62 may be covered by the foamed polymer material. This has an advantage of placing plate 50 in a central area of midsole element 40, thereby permitting midsole element 40 to flex and bend. Accordingly, the foamed polymer material of midsole element 40 extends over each of surfaces 51 and 52 and around perimeter edge 53, but areas of lower surface 52 remain exposed.

Many articles of footwear incorporate plates that impart stiffness to the sole structure. That is, plates in many articles of footwear are relatively stiff and inflexible members that inhibit flex of the sole structure. In contrast, plate 50 facilitates flex and has a thickness (i.e., distance between surfaces 51 and 52) that is relatively small in comparison with the stiff and inflexible members that inhibit flex. More particularly, at least eighty percent of plate 50 has a thickness in a range of 0.5 and 1.5 millimeters. When formed from one of the polymer materials discussed above, or another conventional polymer material, a thickness in a range of 0.5 and 1.5 millimeters imparts significant flex to sole structure 30. Although plate 50 does not impart significant stiffness to sole structure 30, plate 50 provides various advantages, including moderating or otherwise reducing the perception of chambers 61 and 62. That is, plate 50 effectively prevents or minimizes the degree to which the lower surface of the foot feels or senses the presence of chambers 61 and 62. Additionally, plate 50 adds strength to midsole element 40 that inhibits cracking or splitting at high flex points. Accordingly, plate 50 has a relatively small thickness that facilitates flex, while moderating the feel of chambers 61 and 62 and adding strength to midsole element 40.

Various aspects of plate 50 may vary from the relatively planar configuration depicted in the figures. For example, plate 50 may be contoured in areas that join with chambers 61 and 62, or may be contoured to form a depression in heel region 13 or a protrusion in midfoot region 12. Plate 50 may also have a segmented or two-piece configuration, or plate 50 may be formed from three or four separate pieces. In further configurations, plate 50 may also have a plurality of ribs or apertures that vary the properties of sole structure 30. Many of these variations will be discussed in greater detail below.

Each of chambers 61 and 62 have the general configuration of a bladder formed from a polymer material that encloses a fluid (e.g., gas, liquid, gel) in interiors 63. Although the fluid within chambers 61 and 62 may be pressurized, the fluid may also be at a substantially ambient pressure. Chambers 61 and 62 are secured to plate 50 and extend downward from plate 50. More particularly, upper areas of chambers 61 and 62 are positioned adjacent and secured to plate 50. Various adhesives, thermal bonding techniques, or mechanical systems may be utilized to secure chambers 61 and 62 to plate 50. As discussed above, the foamed polymer material of midsole element 40 exposes areas of lower surface 52. In this configuration, the foamed polymer material exposes a first area of plate 50, to which chamber 61 is secured, and the foamed polymer material exposes a second area of plate 50, to which chamber 62 is secured. Note that some of the foamed polymer material of midsole element 40 may be located on lower surface 52 (see FIGS. 7A and 7B) and extend between the first and second area (i.e., between chambers 61 and 62). Lower areas of chambers 61 and 62 are positioned adjacent and secured to outsole 70. In this configuration, sidewalls or peripheral surfaces of chambers 61 and 62 are exposed to an exterior of footwear 10 from forefoot region 11 to heel region 13 on both lateral side 14 and medial side 15. As examples, chambers 61 and 62 may incorporate various features or exhibit the general configurations of fluid-filled chambers disclosed in U.S. Pat. No. 7,556,846 to Dojan, et al.; U.S. Pat. No. 7,243,443 to Swigart; U.S. Pat. No. 6,571,490 to Tawney; U.S. Pat. No. 7,131,218 to Schindler; U.S. Patent Application Publication 2008/0276490 to Holt, et al.; and U.S. Patent Application Publication 2009/0151196 to Schindler, et al.

A wide range of polymer materials may be utilized for chambers 61 and 62. In selecting a material for chambers 61 and 62, the ability of the material to prevent the diffusion of the fluid contained by each of chambers 61 and 62 may be considered, as well as the engineering properties of the material (e.g., tensile strength, stretch properties, fatigue characteristics, dynamic modulus, and loss tangent). When formed from a polymer material, chambers 61 and 62 may have a thickness of approximately 1.0 millimeter, but the thickness may range from 0.25 to 4.0 millimeters or more, for example, depending upon the specific polymer material utilized. Examples of thermoplastic polymer materials that may be suitable for chambers 61 and 62 include urethane, polyurethane, polyester, polyester polyurethane, and polyether polyurethane. Various thermoset polymer materials may also be utilized for chambers 61 and 62. More specific examples of materials that may be utilized for chambers 61 and 62 include the various materials disclosed in any of (a) U.S. Pat. Nos. 4,183,156, 4,219,945, 4,936,029, and 5,042,176 to Rudy; (b) U.S. Pat. Nos. 5,713,141 and 5,952,065 to Mitchell, et al.; and (c) U.S. Pat. Nos. 6,013,340, 6,082,025, 6,127,026, 6,203,868, and 6,321,465 to Bonk, et al.

The fluid within each of chambers 61 and 62 may be pressurized to a common pressure. In some configurations, chambers 61 and 62 may enclose fluids with different pressures. For example, when the fluid within chamber 61 is pressurized less than the fluid within chamber 62, stability may be enhanced and rolling of the foot toward medial side 15 may be reduced to limit foot motions associated with pronation. Chambers 61 and 62 may enclose fluids pressurized between zero and three-hundred-fifty kilopascals (i.e., approximately fifty-one pounds per square inch) or more. In addition to air and nitrogen, the fluid contained by chambers 61 and 62 may include octafluorapropane or be any of the gasses disclosed in U.S. Pat. No. 4,340,626 to Rudy, such as hexafluoroethane and sulfur hexafluoride, for example.

Outsole 70 is secured to lower surfaces of chambers 61 and 62 and may be formed from a textured, durable, and wear-resistant material (e.g., rubber) that forms the ground-contacting portion of footwear 10. Various adhesives, thermal bonding techniques, or mechanical systems may be utilized to secure outsole 70 to chambers 61 and 62.

When the foot is located within upper 20, midsole element 40, plate 50, chambers 61 and 62, and outsole 70 extend under the foot in order to attenuate ground reaction forces, provide traction, impart stability, and limit various foot motions. More particularly, the foamed polymer material of midsole element 40 and the fluid-filled aspects of chambers 61 and 62 compress or otherwise deform upon the application of forces from the foot to attenuate ground reaction forces. When the fluid within chamber 61 is pressurized less than the fluid within chamber 62, stability may be enhanced and rolling of the foot toward medial side 15 may be reduced to limit foot motions associated with pronation. Plate 50 imparts various advantages, including moderating or otherwise reducing the perception of chambers 61 and 62. That is, plate 50 effectively prevents or minimizes the degree to which the lower surface of the foot feels or senses the presence of chambers 61 and 62. Additionally, plate 50 moves and flexes with the foot and adds strength to midsole element 40. Outsole 70 also has a durable and wear-resistant configuration that imparts traction. Accordingly, the various elements of sole structure 30 operate cooperatively to provide various advantages to footwear 10.

Manufacturing Method

Figure 8:
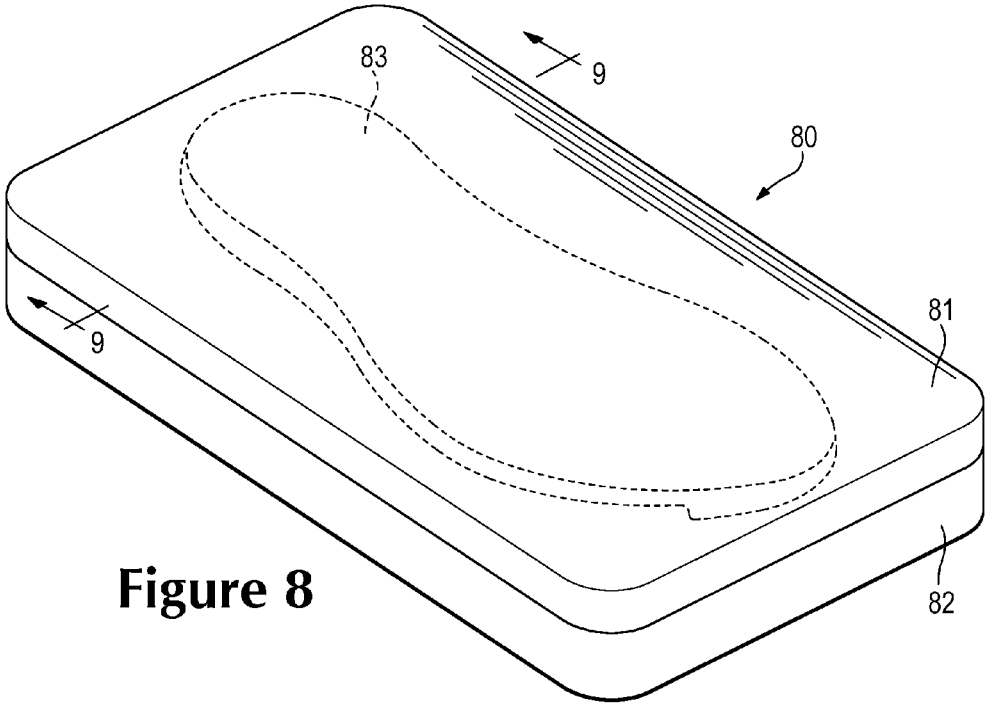
FIG. 8 is a perspective view of a mold for forming a portion of the sole structure.
Figure 9:
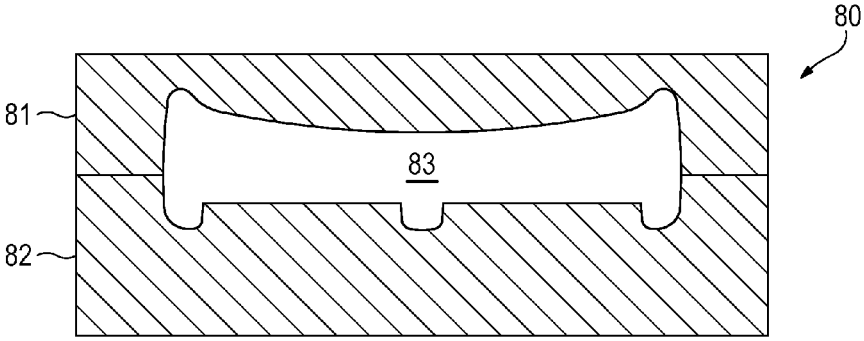
FIG. 9 is a cross-sectional view of the mold, as defined by section line 9 in FIG. 8.

A variety of techniques may be utilized to manufacture sole structure 30. As an example, a mold may be utilized to form midsole element 40 and embed plate 50 within midsole element 40. Chambers 61 and 62 may then be secured to plate 50, and outsole 70 may be secured to chambers 61 and 62. As an example, a mold 80, which is depicted in FIG. 8, may be utilized. Mold 80 includes a first mold portion 81 and a corresponding second mold portion 82. When joined together, as depicted in FIG. 8, mold portions 81 and 82 form a cavity 83 having dimensions substantially equal to the combination of midsole element 40 and plate 50.

Figure 10A:
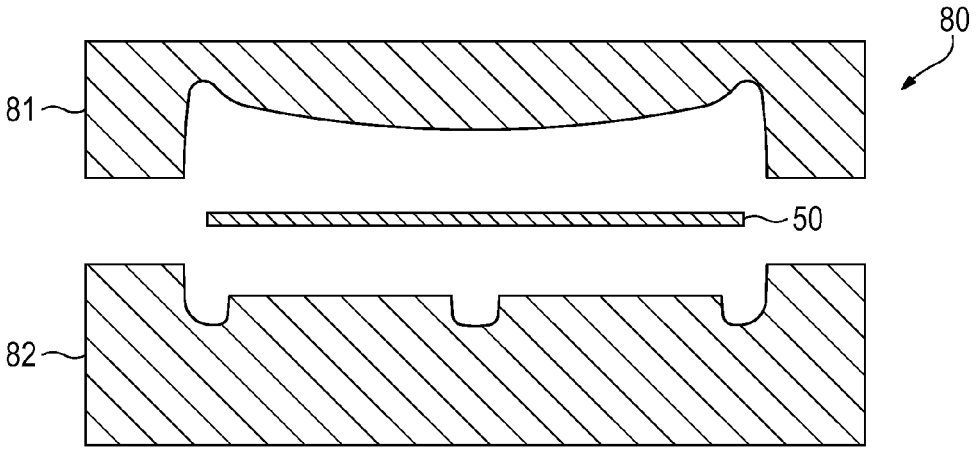
FIGS. 10A-10G are schematic cross-sectional views depicting a method of manufacturing the sole structure.
Figure 10B:
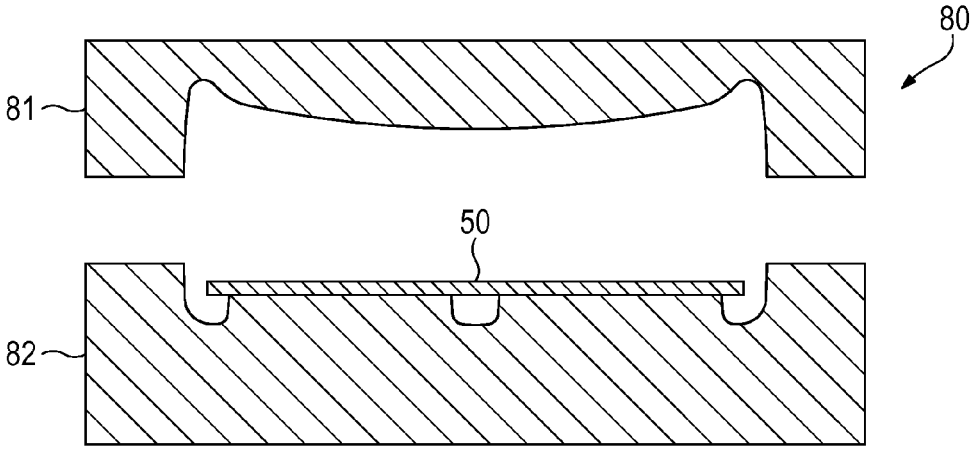
Figure 10C:
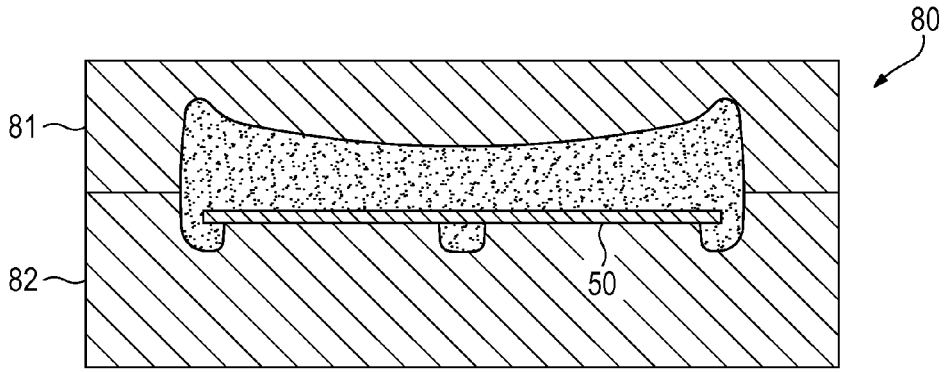
Figure 10D:
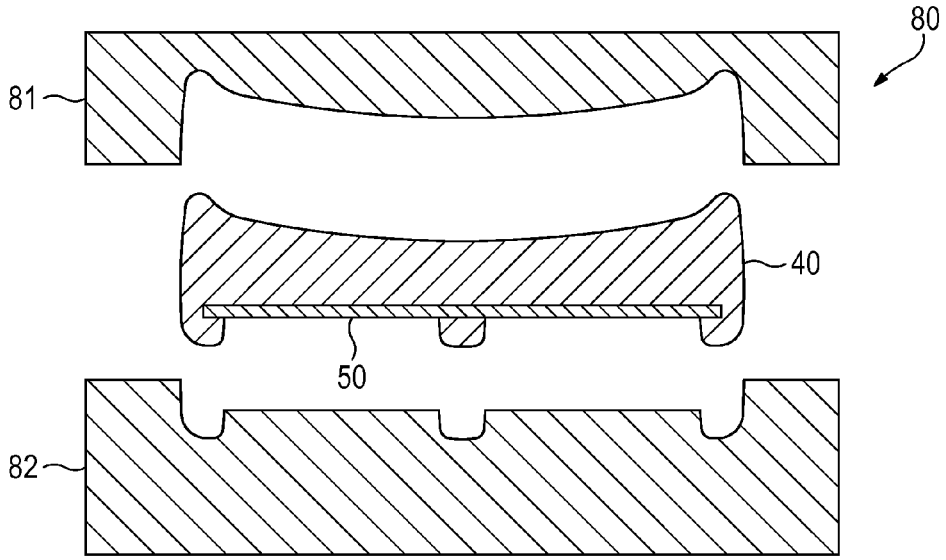

The manner in which mold 80 is utilized in the manufacture of sole structure 30 will now be discussed in greater detail. An injection-molding process, for example, may be utilized to form plate 50, which is then cleansed with a detergent or alcohol, for example, in order to remove surface impurities, such as a mold release agent or fingerprints. Plate 50 may also be plasma treated to enhance bonding with the foamed polymer material of midsole element 40. Following formation and cleansing, plate 50 is placed between mold portions 81 and 82, as depicted in FIGS. 10A and 10B, and mold 80 is closed. A polymer resin with a blowing agent is then injected into cavity 83, as depicted in FIG. 10C. The polymer resin and blowing agent extend around plate 50. Upon hardening or setting, as well as expanding, the polymer resin forms the foamed polymer material of midsole element 40. Mold 80 is then opened, as depicted in FIG. 10D, and the combination of midsole element 40 and plate 50 are removed.

Figure 10E:
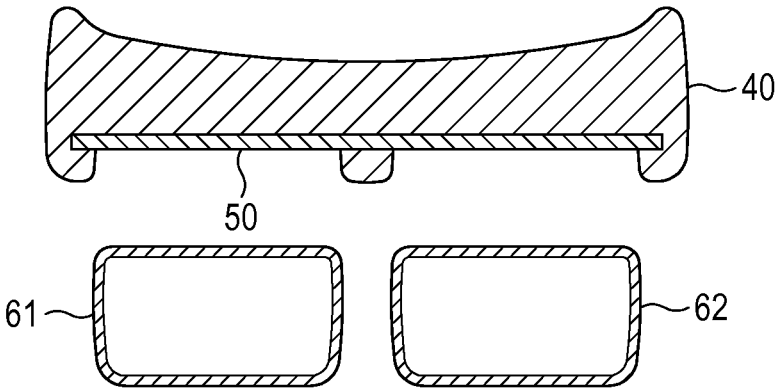
Figure 10F:
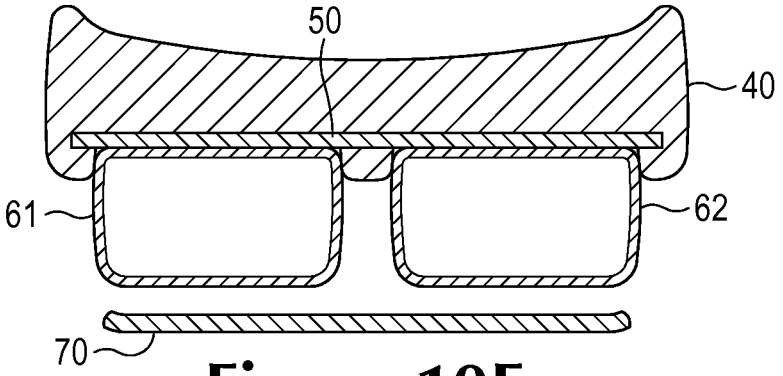
Figure 10G:
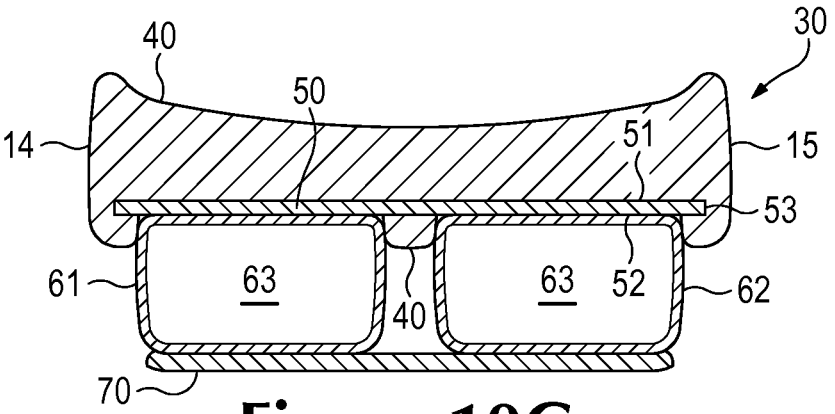

Once the combination of midsole element 40 and plate 50 are formed, chambers 61 and 62 may be placed adjacent to areas of plate 50, as depicted in FIG. 10E, and bonded with plate 50. Outsole 70 is then placed adjacent to chambers 61 and 62, as depicted in FIG. 10F, and bonded with chambers 61 and 62, as depicted in FIG. 10G, to substantially complete the manufacture of sole structure 30. Upon bonding with upper 20, the production of footwear 10 is essentially complete.

Further Configurations

Figure 11A:
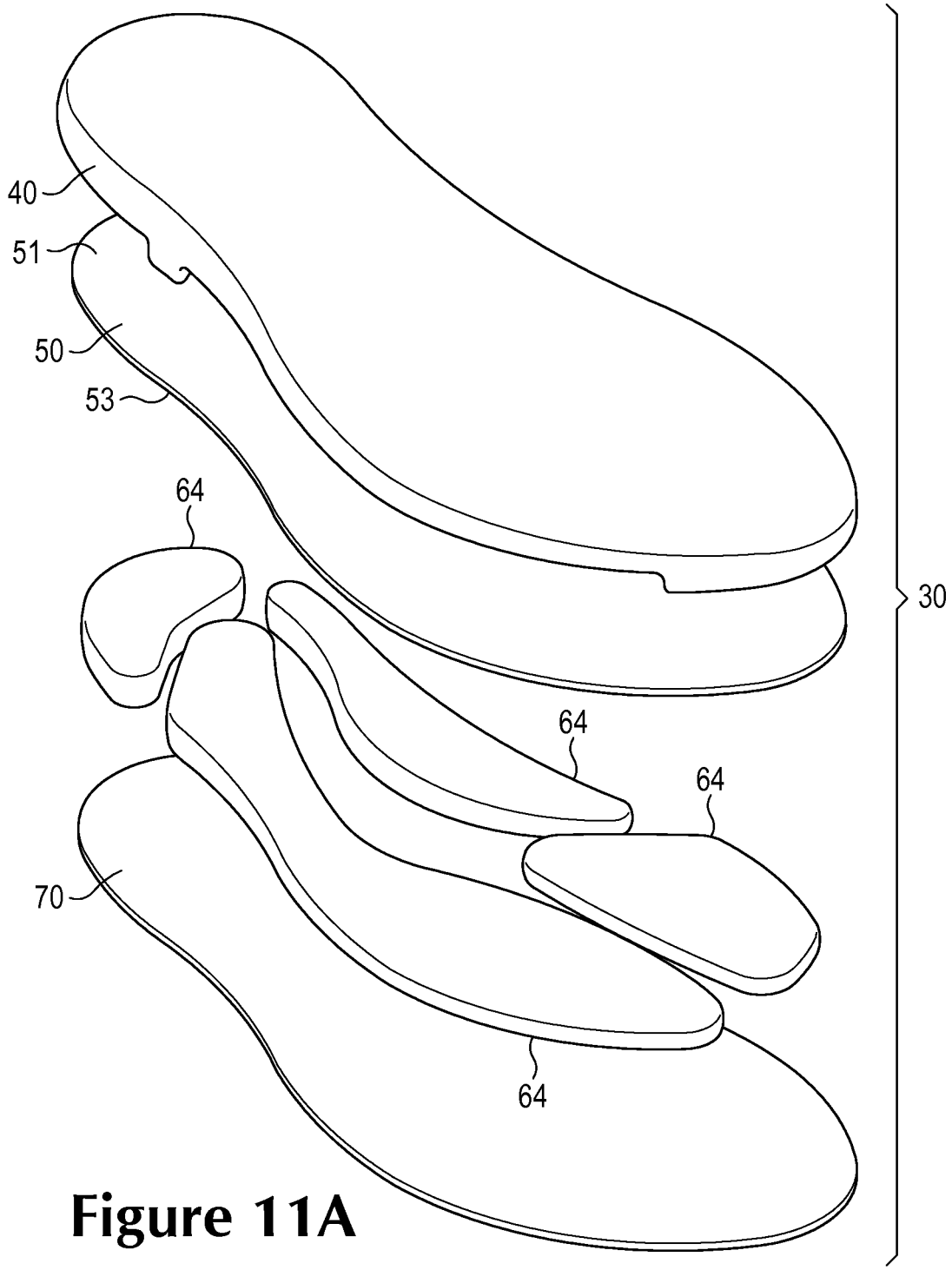
FIGS. 11A-11D are exploded perspective views corresponding with FIG. 4 and depicting further configurations of the sole structure.
Figure 11B:
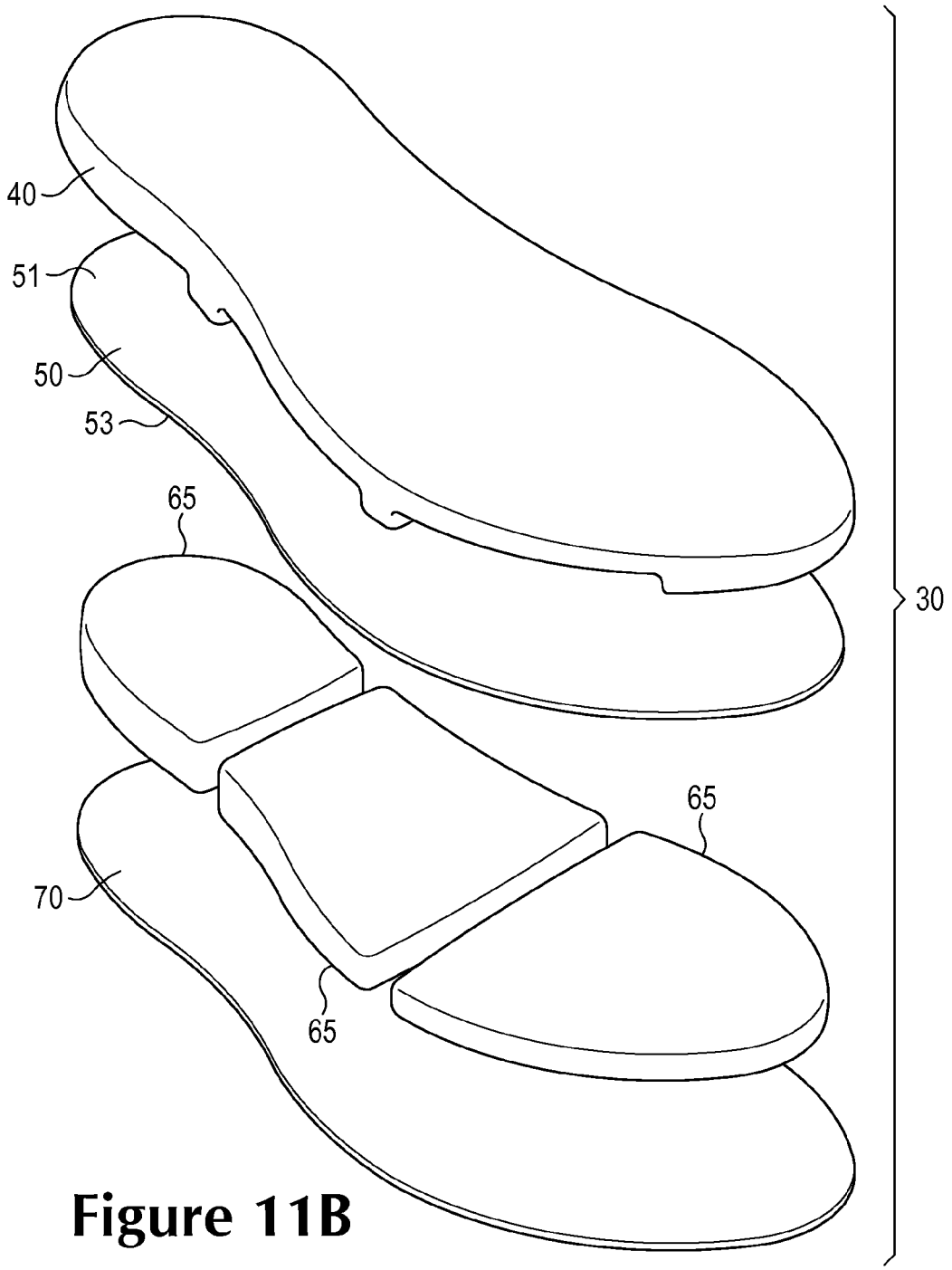
Figure 11C:
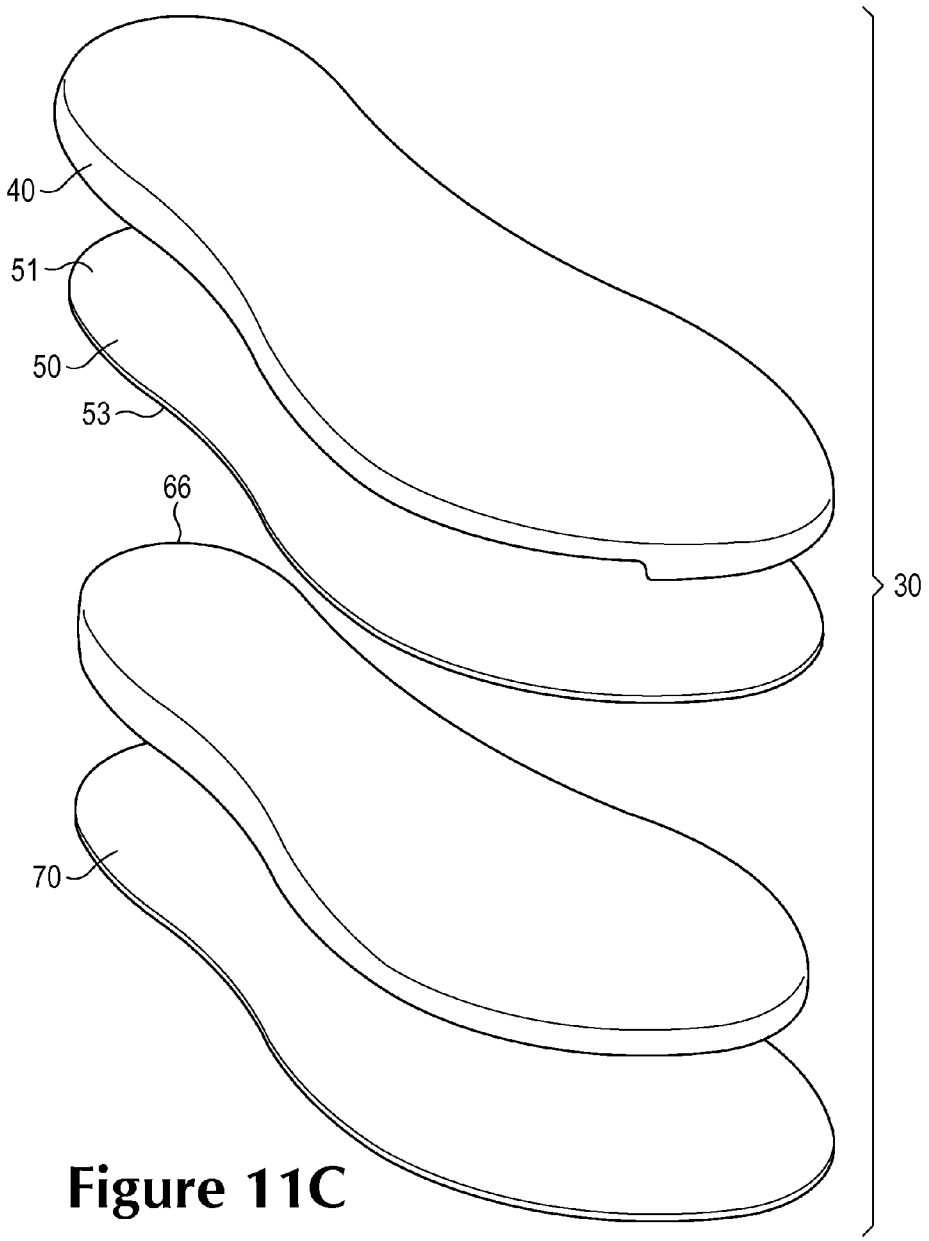
Figure 11D:
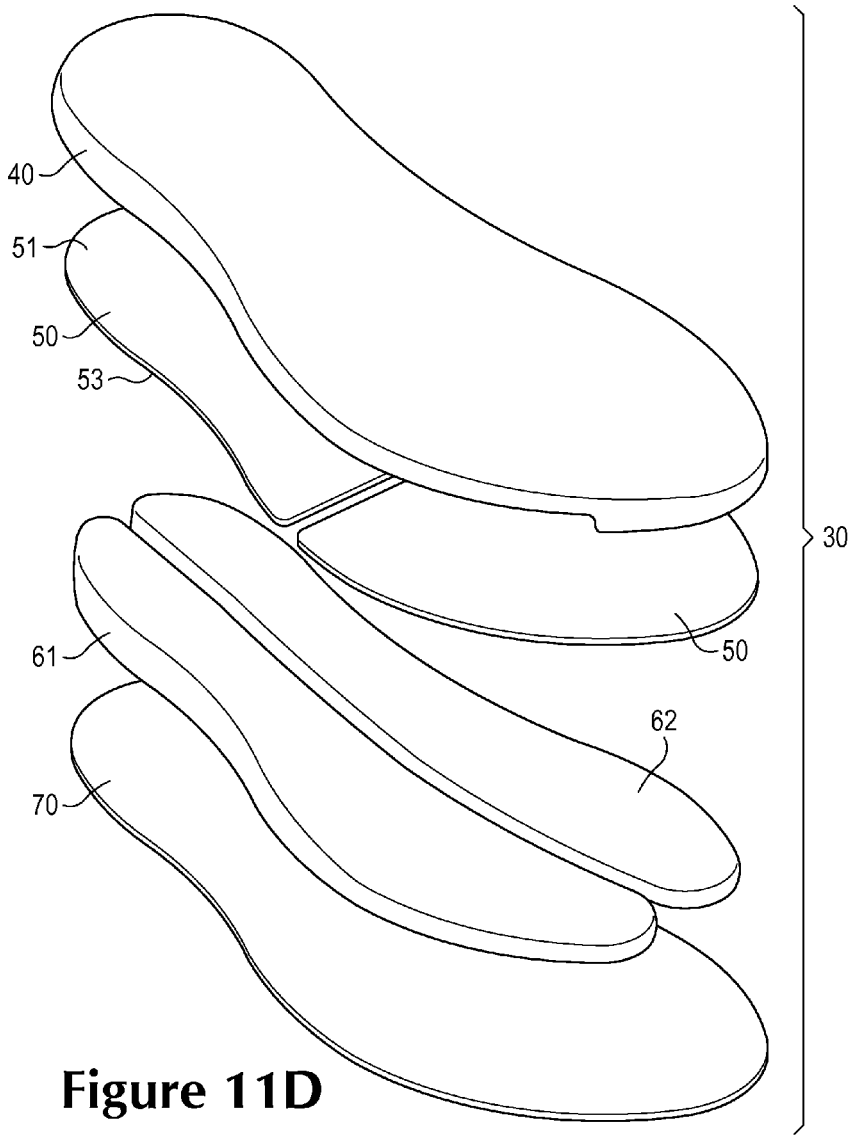
Figure 12A:
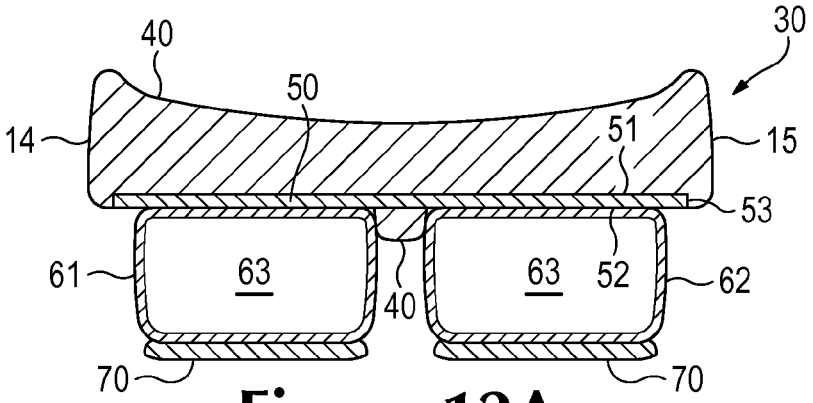
FIGS. 12A-12E are cross-sectional views corresponding with FIG. 7A and depicting further configurations of the sole structure.

The above discussion and associated figures provide an example of a suitable configuration for sole structure 30. Various aspects of sole structure 30 may, however, vary to impart different properties or performance attributes to footwear 10. As an example, FIG. 11A depicts a configuration wherein sole structure 30 incorporates four chambers 64. In this configuration, chambers 64 are secured to four areas of plate 50 and extend through various regions of sole structure 30. More particularly, one of chambers 64 extends along substantially all of lateral side 14, two of chambers 64 are located on medial side 15, and one of chambers 64 is located in heel region 13 and on lateral side 14 (i.e., in a rear-lateral portion of sole structure 30). Given that each of chambers 64 have different shapes and are located in different areas, the degree of ground reaction force attenuation, stability, and limitation on various foot motions may vary. That is, chambers 64 may be located to impart different properties or performance attributes to footwear 10. Another configuration is depicted in FIG. 11B, wherein three chambers 65 are each located in forefoot region 11, midfoot region 12, and heel region 13 to impart specific properties or performance attributes to different areas of footwear 10. In a further configuration, a single chamber 66 may be utilized in sole structure 30, as depicted in FIG. 11C. As a further variation, plate 50 may have a segmented or two-piece configuration, as depicted in FIG. 11D. Outsole 70 may be a single element that forms a majority of a ground-engaging surface of footwear 10, but may also be formed from discrete or separate elements. Referring to FIG. 12A, outsole 70 includes separate elements that are secured to each of chambers 61 and 62. That is, one element of outsole 70 is secured to chamber 61 and the other element of outsole 70 is secured to chamber 62.

Figure 12B:
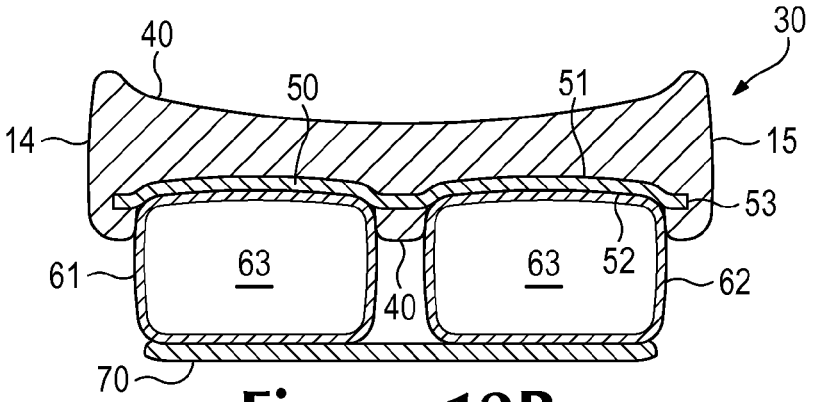

A variety of aspects relating to plate 50 may also vary. Although plate 50 may have a planar configuration, plate 50 may also be contoured. For example, FIG. 12B depicts a configuration the exposed areas of plate 50 (i.e., the areas that secure to chambers 61 and 62) have a concave configuration, and surfaces of chambers 61 and 62 that are secured to plate 50 have a convex configuration. That is, plate 50 is contoured to the shape of chambers 61 and 62. In further configurations, plate 50 may be contoured to form a depression in heel region 13 for receiving the heel of the wearer, or plate 50 may form a protrusion in midfoot region 12 to provide an arch support, for example.

Figure 13A:
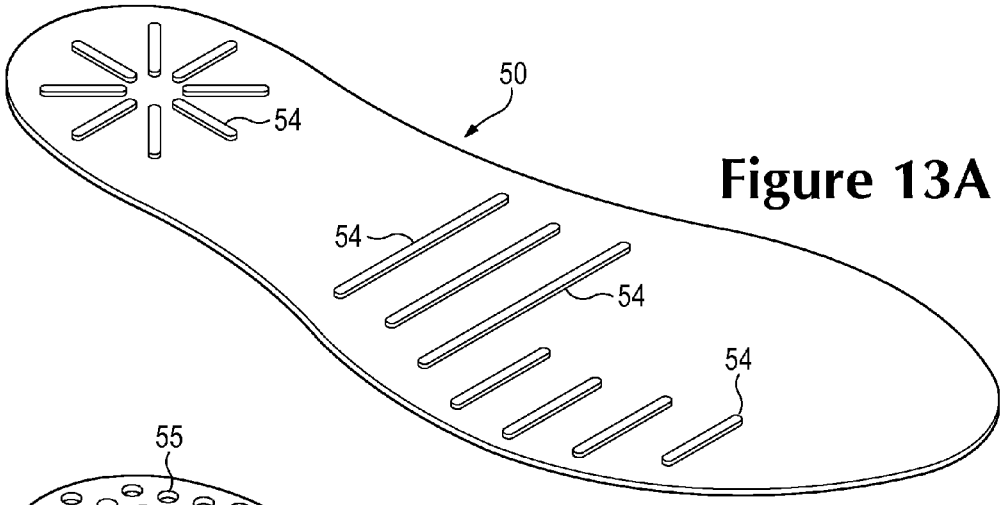
FIGS. 13A-13C are perspective views depicting further configurations of a plate from the sole structure.
Figure 13B:
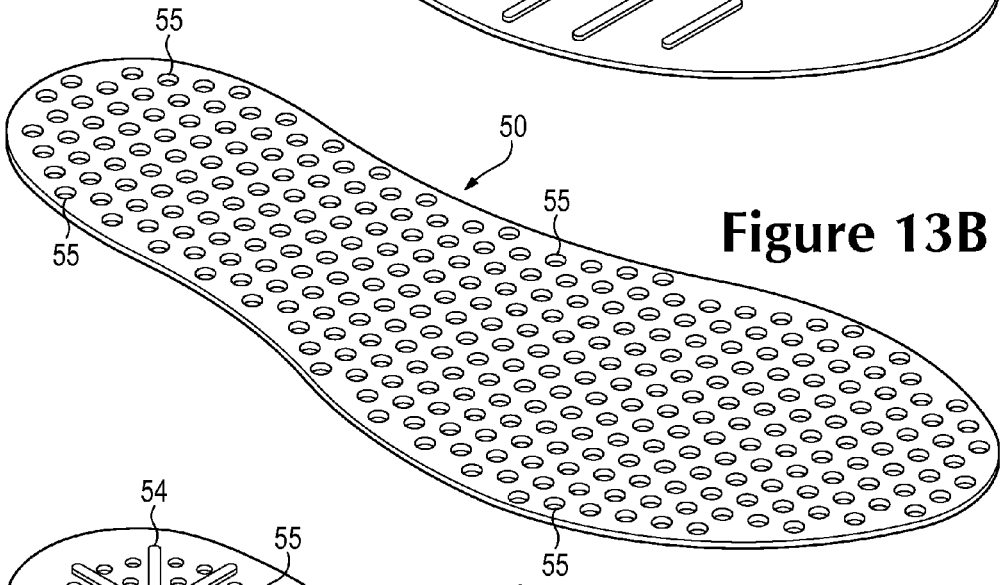
Figure 13C:
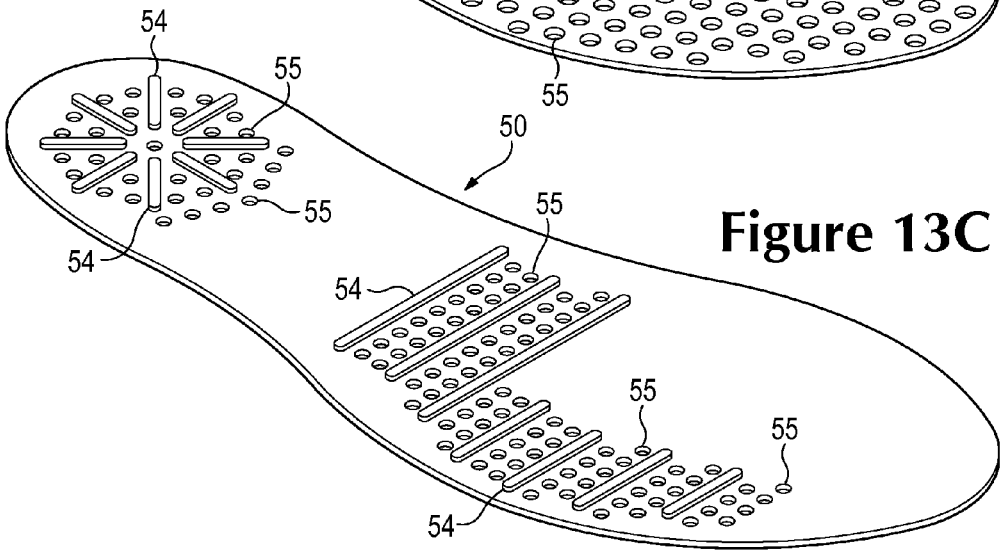

Plate 50 may also include a plurality of ribs 54, as depicted in FIG. 13A. As an example, a plurality of elongate ribs 54 may radiate outward from a central area in heel region 13, and ribs 54 may extend laterally in regions 11 and 12. Moreover, ribs 54 may protrude outward from either or both of surfaces 51 and 52. In addition to imparting flex resistance in various areas of plate 50, ribs 54 may induce plate 50 to flex in specific directions in different areas of plate 50. As discussed above, at least eighty percent of plate 50 may have a thickness in a range of 0.5 and 1.5 millimeters. Ribs 54, however, may have thicknesses that are greater than 1.5 millimeters. Plate 50 may also include a plurality of apertures 55, as depicted in FIG. 13B, that extend through the thickness of plate 50 (i.e., between surfaces 51 and 52). In addition to enhancing the flex of plate 50, apertures 55 may improve bonding with the foamed polymer material of midsole element 40. That is, the foamed polymer material may extend through apertures 55 to secure plate 50 to midsole element 40. In a further configuration, as depicted in FIG. 13C, plate 50 may include both ribs 54 and apertures 55.

Figure 12C:
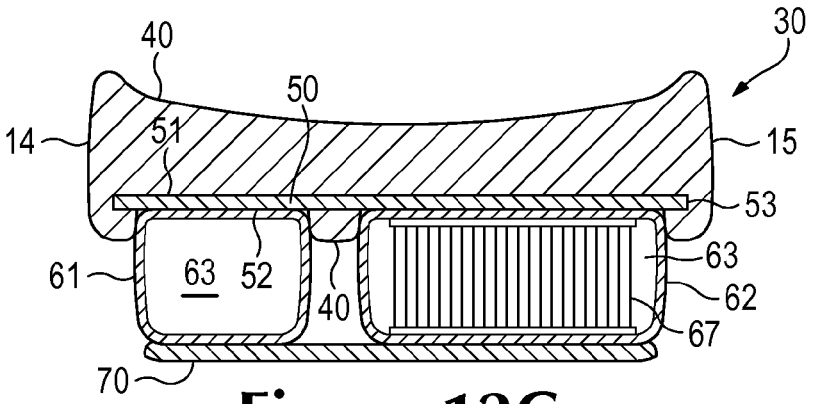
Figure 12D:
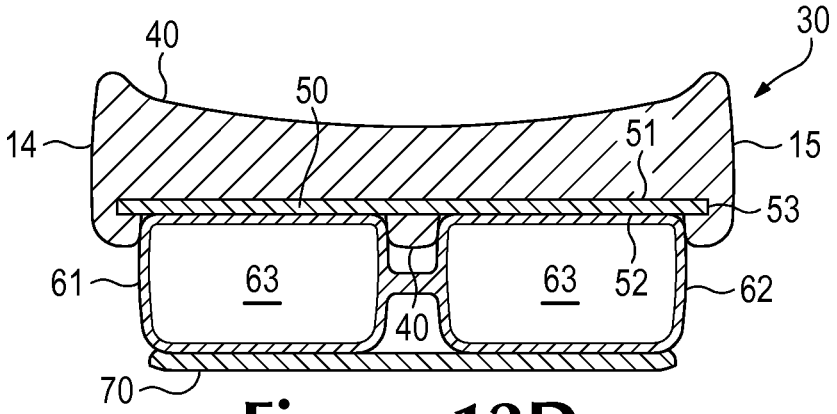
Figure 12E:
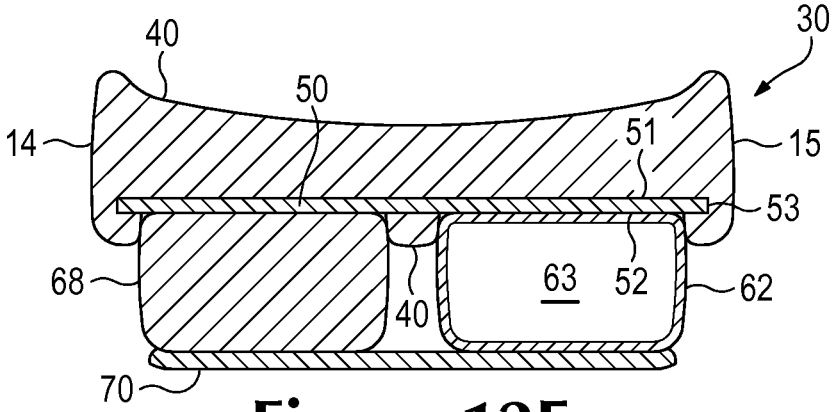

The configurations of chambers 61 and 62 may also vary. Referring to FIG. 12C, chamber 62 is depicted as incorporating a tensile member 67. Either of chambers 61 and 62 may, therefore, have a configuration that is similar to a bladder disclosed in U.S. Pat. No. 6,837,951 to Rapaport. Although chambers 61 and 62 may be separate structures, FIG. 12D depicts a configuration wherein the polymer material of chambers 61 and 62 is connected. As an alternative to chambers 61 and 62, other elements may be utilized. Referring to FIG. 12E, for example, a column 68 is utilized in place of chamber 61. Various other supports may also be utilized in place of chambers 61 and 62, including polymer members, springs, or blocks, for example.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the sole structure comprising:

a midsole element formed from a foamed polymer material and positioned adjacent to the upper;

a plate formed from a polymer material wherein the plate has an upper surface facing toward the upper and an opposite lower surface facing away from the upper and wherein the plate is at least partially embedded within the midsole element so that the foamed polymer material covers the upper surface and at least a portion of a perimeter edge of the plate and the foamed polymer material exposes at least a portion of the lower surface; and a plurality of members selected from the group consisting of fluid-filled chambers, columns, polymer support members, and springs, wherein the plurality of members are secured to the exposed portion of the lower surface of the plate, wherein the polymer foam material extends over the lower surface between the plurality of members.

2. An article of footwear according to claim 1, wherein the plurality of members include one or more fluid-filled chambers.

3. An article of footwear according to claim 2, wherein the plurality of members include two fluid-filled chambers that differ in pressure within the chambers.

4. An article of footwear according to claim 2, wherein at least one fluid-filled chamber incorporates a tensile member.

5. An article of footwear according to claim 1, wherein a first member is secured in a first area of the exposed portion located adjacent to a lateral side of the sole structure and a second member is secured in a second area of the exposed portion located adjacent to a medial side of the sole structure.

6. An article of footwear according to claim 5, wherein a third member is secured in a third area of the exposed portion located in a rear-lateral portion of the sole structure.

7. An article of footwear according to claim 5, wherein at least one of the first member and the second member extends from a forefoot region of the sole structure to a heel region of the sole structure.

8. An article of footwear according to claim 1, wherein at least one of the plurality of members is secured to the exposed portion in an area of the exposed portion that is convex.

9. An article of footwear according to claim 1, wherein at least eighty percent of the plate has a thickness in a range of 0.5 to 1.5 millimeters.

10. An article of footwear according to claim 1, wherein the plate comprises one or both of:

(1) a plurality of apertures extending from the upper surface to the lower surface and (2) a plurality of elongate ribs extending outward from at least one of the upper surface and the lower surface.

11. An article of footwear according to claim 1, wherein an outsole is secured to the plurality of members.

12. An article of footwear according to claim 1, wherein the foamed polymer extends around the perimeter edge of the plate and contacts the lower surface of the plate proximate to the perimeter edge.

* * * * *